US010476210B1

(12) United States Patent
Trout et al.

(10) Patent No.: US 10,476,210 B1
(45) Date of Patent: Nov. 12, 2019

(54) GROUND SHIELD FOR A CONTACT MODULE

(71) Applicants: TE CONNECTIVITY CORPORATION, Berwyn, PA (US); TYCO ELECTRONICS JAPAN G.K., Kawasaki-shi (JP)

(72) Inventors: David Allison Trout, Lancaster, PA (US); Jeffrey Byron McClinton, Harrisburg, PA (US); Justin Dennis Pickel, Hummelstown, PA (US); Tetsuya Katano, Kanagawa (JP); Masayuki Aizawa, Machida (JP); Masaaki Iwasaki, Yokohama (JP); Teruhiko Matsudaira, Kanagawa (JP)

(73) Assignees: TE CONNECTIVITY CORPORATION, Berwyn, PA (US); TYCO ELECTRONICS JAPAN G.K., Kawasaki-Shi (JP)

( * ) Notice: Subject to any disclaimer, the term of this patent is extended or adjusted under 35 U.S.C. 154(b) by 0 days.

(21) Appl. No.: 16/166,329

(22) Filed: Oct. 22, 2018

(51) Int. Cl.
*H01R 13/6587* (2011.01)

(52) U.S. Cl.
CPC ..... *H01R 13/6587* (2013.01)

(58) Field of Classification Search
CPC ..... H01R 13/6587
USPC ..... 439/607.07, 607.01, 607.27
See application file for complete search history.

(56) References Cited

U.S. PATENT DOCUMENTS 6,299,484 B2 * 10/2001 Van Woensel ..... H01R 13/6587 439/607.07
6,843,687 B2 1/2005 McGowan et al.
7,381,092 B2 * 6/2008 Nakada ..... H01R 13/514 439/607.1
7,410,393 B1 * 8/2008 Rothermel ..... H01R 29/00 439/49
7,811,128 B2 * 10/2010 Pan ..... H01R 23/688 439/607.03
7,862,376 B2 * 1/2011 Sypolt ..... H01R 13/6587 439/607.07
8,157,595 B2 * 4/2012 Saraswat ..... H01R 13/6625 439/607.06
8,591,260 B2 11/2013 Davis et al.
8,662,924 B2 * 3/2014 Davis ..... H01R 13/6477 439/607.07
8,690,604 B2 * 4/2014 Davis ..... H01R 12/00 439/607.07

(Continued)

*Primary Examiner* — Tulsidas C Patel
*Assistant Examiner* — Peter G Leigh

(57) ABSTRACT

A contact module includes a dielectric holder having first and second sides extending between a mating end and a mounting end. The contact module includes signal contacts held by the dielectric holder along a contact plane. The contact module includes a first ground shield coupled to the first side of the dielectric holder and providing electrical shielding for the signal contacts and a second ground shield coupled to the second side of the dielectric holder and providing electrical shielding for the signal contacts, the ground shield having skewer openings. The contact module includes ground skewers having posts extending from the first ground shield through the dielectric holder. The posts are electrically connected to the first ground shield and extend into corresponding skewer openings of the second ground shield to electrically connect the first ground shield to the second ground shield.

22 Claims, 11 Drawing Sheets

(56) References Cited

U.S. PATENT DOCUMENTS

| | | | | |
|---|---|---|---|---|
| 8,894,442 | B2 * | 11/2014 | McClellan | H01R 13/6587 439/607.05 |
| 8,905,786 | B2 * | 12/2014 | Davis | H01R 13/6587 439/108 |
| 9,225,122 | B1 * | 12/2015 | Evans | H01R 13/6588 |
| 9,407,045 | B2 * | 8/2016 | Horning | H01R 13/6594 |
| 9,774,144 | B2 * | 9/2017 | Cartier, Jr. | H01R 13/6585 |
| 2001/0012730 | A1 * | 8/2001 | Ramey | H01R 12/585 439/607.05 |
| 2017/0025783 | A1 * | 1/2017 | Astbury | H01R 12/716 |
| 2017/0098901 | A1 * | 4/2017 | Regnier | H01R 13/6473 |
| 2018/0219330 | A1 | 8/2018 | Morgan et al. | |

* cited by examiner

GROUND SHIELD FOR A CONTACT MODULE

BACKGROUND OF THE INVENTION

The subject matter herein relates generally to shielding structures for contact modules of electrical connectors.

Some electrical systems utilize electrical connectors, such as header assemblies and receptacle assemblies, to interconnect two circuit boards, such as a motherboard and daughtercard. Some known electrical connectors include a front housing holding a plurality of contact modules arranged in a contact module stack. The electrical connectors provide electrical shielding for the signal conductors of the contact modules. For example, ground shields may be provided on one or both sides of each contact module. However, at high speeds, the electrical shielding of known electrical connectors may be insufficient. For example, while the ground shield(s) may provide shielding along the sides of the signal conductors, known electrical connectors do not provide sufficient additional electrical shielding above and/or below the signal conductors throughout the length of the contact modules. For example, the additional electrical shielding may only be provided at the mating interface with the mating electrical connector and not along the length of the signal conductors between the mating end and the mounting end mounted to the circuit board.

Some known electrical connectors include guard traces or ground contacts interspersed with the signal contacts to provide shielding therebetween. However, there is insufficient electrical commoning of the ground contacts with the ground shields along the sides of the contact modules. For example, some known contact modules only electrically common the ground shields and the ground contacts at the circuit board and at the mating electrical connector. However, the transition sections of the ground contacts are not electrically commoned with the ground shields. Additionally, the ground shields typically include large openings formed by stamping and bending sections to form the shielding structure.

A need remains for a shielding structure for contact modules that provides electrical commoning of the components of the shield structure to provide robust electrical shielding for the signal contacts.

BRIEF DESCRIPTION OF THE INVENTION

In one embodiment, a contact module is provided including a dielectric holder having first and second sides extending between a mating end and a mounting end. The contact module includes signal contacts held by the dielectric holder along a contact plane defined between the first and second sides having mating portions extending from the mating end, mounting portions extending from the mounting end for termination to a circuit board, and transition portions extending through the dielectric holder between the mating and mounting portions. The contact module includes a first ground shield coupled to the first side of the dielectric holder and providing electrical shielding for the signal contacts and a second ground shield coupled to the second side of the dielectric holder and providing electrical shielding for the signal contacts, the ground shield having skewer openings. The contact module includes ground skewers having posts extending from the first ground shield through the dielectric holder. The posts are electrically connected to the first ground shield and extend into corresponding skewer openings of the second ground shield to electrically connect the first ground shield to the second ground shield.

In another embodiment, a contact module is provided including a dielectric holder having first and second sides extending between a mating end and a mounting end. The contact module includes signal contacts held by the dielectric holder along a contact plane defined between the first and second sides having mating portions extending from the mating end, mounting portions extending from the mounting end for termination to a circuit board, and transition portions extending through the dielectric holder between the mating and mounting portions. The contact module includes guard traces held by the dielectric holder along the contact plane between corresponding signal contacts providing electrical shielding between the corresponding signal contacts and having guard trace openings. The contact module includes a ground shield coupled to the first side of the dielectric holder and providing electrical shielding for the signal contacts and having skewer openings. The contact module includes ground skewers separate and discrete from the ground shield having posts extending into corresponding skewer openings and into corresponding guard trace openings to electrically connect the ground shield and the guard traces.

In a further embodiment, a contact module is provided including a dielectric holder having first and second sides extending between a mating end and a mounting end. The contact module includes signal contacts held by the dielectric holder along a contact plane defined between the first and second sides having mating portions extending from the mating end, mounting portions extending from the mounting end for termination to a circuit board, and transition portions extending through the dielectric holder between the mating and mounting portions. The contact module includes a first ground shield coupled to the first side of the dielectric holder and providing electrical shielding for the signal contacts having first skewer openings. The contact module includes a second ground shield coupled to the second side of the dielectric holder and providing electrical shielding for the signal contacts having second skewer openings. The contact module includes ground skewers separate and discrete from the first and second ground shield having posts extending through the dielectric holder. The posts extend into corresponding first and second skewer openings to electrically connect the first ground shield to the second ground shield.

DETAILED DESCRIPTION OF THE INVENTION

Figure 1:
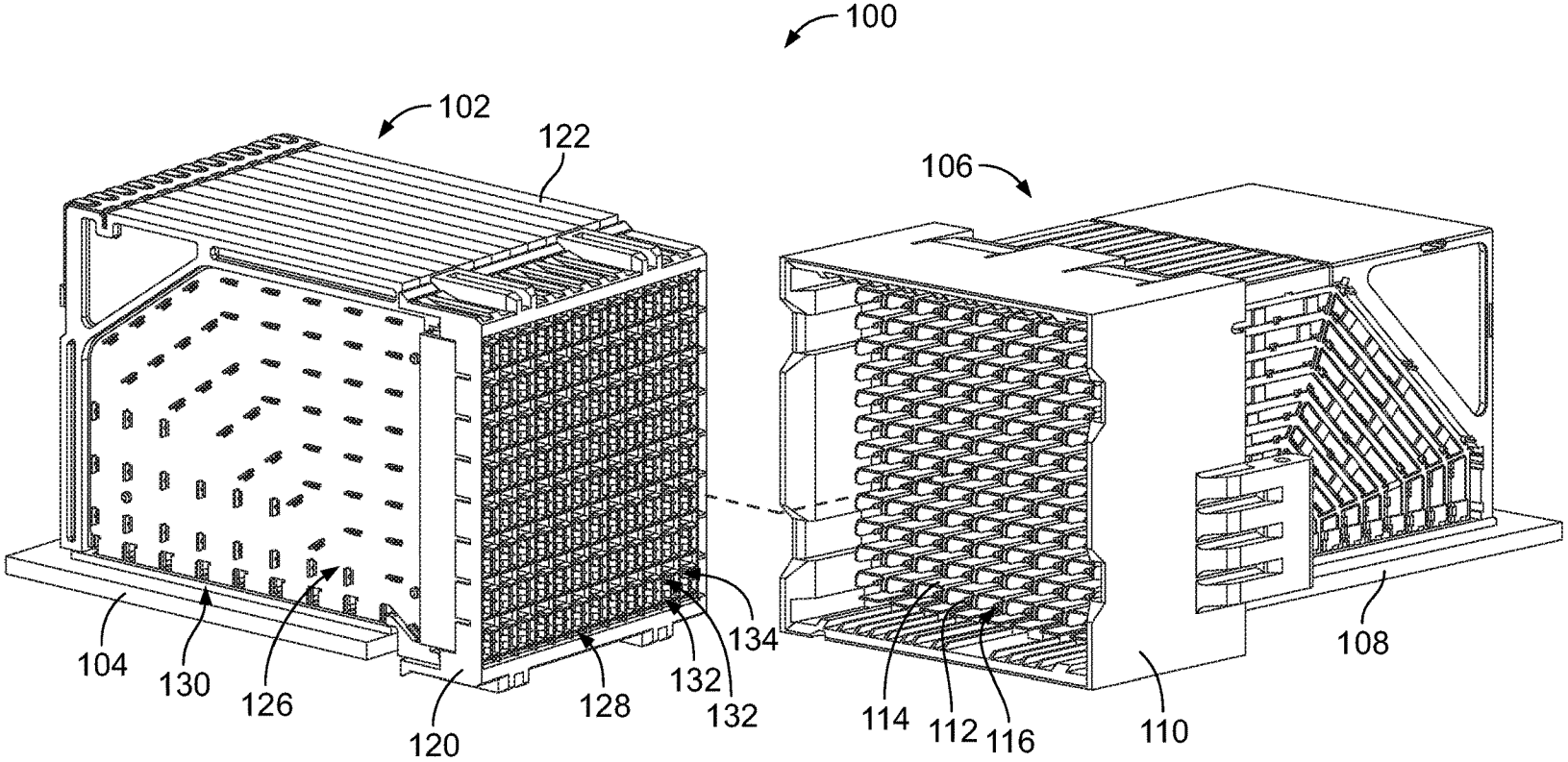
FIG. 1 is a front perspective view of an electrical connector system formed in accordance with an exemplary embodiment.

FIG. 1 is a front perspective view of an electrical connector system 100 formed in accordance with an exemplary embodiment. The connector system 100 includes an electrical connector 102 configured to be mounted to a circuit board 104, and a mating electrical connector 106 which may be mounted to a circuit board 108. The mating electrical connector 106 may be a header connector. Various types of connector assemblies may be used in various embodiments, such as a right angle connector, a vertical connector or another type of connector. The electrical connector 102 or the mating electrical connector 106 may be oriented 90° relative to the view illustrated (to align the signal contacts and the ground contacts at the mating interface) for mating, which would orient the circuit board 104 or the circuit board 108 at a right angle relative to the other circuit board.

The mating electrical connector 106 includes a housing 110 holding a plurality of mating signal contacts 112 and mating ground shields 114. The mating signal contacts 112 may be arranged in pairs 116. Each mating ground shield 114 extends around corresponding mating signal contacts 112, such as the pairs 116 of mating signal contacts 112. In the illustrated embodiment, the mating ground shields 114 are C-shaped having three walls extending along three sides of each pair of mating signal contacts 112. The mating ground shield 114 below the pair 116 provides electrical shielding across the bottom of the pair 116. As such, the pairs 116 of mating signal contacts 112 are circumferentially surrounded on all four sides by the mating ground shields 114.

The electrical connector 102 includes a housing 120 that holds a plurality of contact modules 122. The contact modules 122 are held in a stacked configuration generally parallel to one another. The contact modules 122 may be loaded into the housing 120 side-by-side in the stacked configuration as a unit or group. Any number of contact modules 122 may be provided in the electrical connector 102. The contact modules 122 each include a plurality of signal contacts 124 (shown in FIG. 2) that define signal paths through the electrical connector 102. The signal contacts 124 are configured to be electrically connected to corresponding mating signal contacts 112 of the mating electrical connector 106.

The electrical connector 102 includes a mating end 128, such as at a front of the electrical connector 102, and a mounting end 130, such as at a bottom of the electrical connector 102. In the illustrated embodiment, the mounting end 130 is oriented substantially perpendicular to the mating end 128. The mating and mounting ends 128, 130 may be at different locations other than the front and bottom in alternative embodiments, such as at the rear, the side or the top. The signal contacts 124 extend through the electrical connector 102 from the mating end 128 to the mounting end 130 for mounting to the circuit board 104.

The signal contacts 124 are received in the housing 120 and held therein at the mating end 128 for electrical termination to the mating electrical connector 106. The signal contacts 124 are arranged in a matrix of rows and columns. In the illustrated embodiment, at the mating end 128, the rows are oriented horizontally and the columns are oriented vertically. Other orientations are possible in alternative embodiments. Any number of signal contacts 124 may be provided in the rows and columns. Optionally, the signal contacts 124 may be arranged in pairs carrying differential signals; however other signal arrangements are possible in alternative embodiments, such as single ended applications. As shown in FIG. 1, the pairs of signal contacts 124 may be arranged in columns (pair-in-column signal contacts). Alternatively, the pairs of signal contacts 124 may be arranged in rows (pair-in-row signal contacts). The signal contacts 124 within each pair may be contained within the same contact module 122.

In an exemplary embodiment, each contact module 122 has a shield structure 126 (shown in FIG. 2) for providing electrical shielding for the signal contacts 124. The shield structure 126 is configured to be electrically connected to the mating ground shields 114 of the mating electrical connector 106. The shield structure 126 may provide shielding from electromagnetic interference (EMI) and/or radio frequency interference (RFI), and may provide shielding from other types of interference as well to better control electrical characteristics, such as impedance, cross-talk, and the like, of the signal contacts 124. The contact modules 122 provide shielding for each pair of signal contacts 124 along substantially the entire length of the signal contacts 124 between the mating end 128 and the mounting end 130. In an exemplary embodiment, the shield structure 126 is configured to be electrically connected to the mating electrical connector and/or the circuit board 104. The shield structure 126 may be electrically connected to the circuit board 104 by features, such as grounding pins and/or surface tabs.

The housing 120 includes a plurality of signal contact openings 132 and a plurality of ground contact openings 134 at the mating end 128. The signal contacts 124 are received in corresponding signal contact openings 132. Optionally, a single signal contact 124 is received in each signal contact opening 132. The signal contact openings 132 may also receive corresponding mating signal contacts 112 of the mating electrical connector 106. In the illustrated embodiment, the ground contact openings 134 are C-shaped extending along one of the sides as well as the top and the bottom of the corresponding pair of signal contact openings 132. However, other orientations are possible in alternative embodiments. The ground contact openings 134 receive mating ground shields 114 of the mating electrical connector 106 therein. The ground contact openings 134 also receive portions of the shield structure 126 (for example, beams and/or fingers) that mate with the mating ground shields 114 to electrically common the shield structure 126 with the mating electrical connector 106.

The housing 120 is manufactured from a dielectric material, such as a plastic material, and provides isolation between the signal contact openings 132 and the ground contact openings 134. The housing 120 isolates the signal contacts 124 from the shield structure 126. The housing 120 isolates each set (for example, differential pair) of signal contacts 124 from other sets of signal contacts 124.

Figure 2:
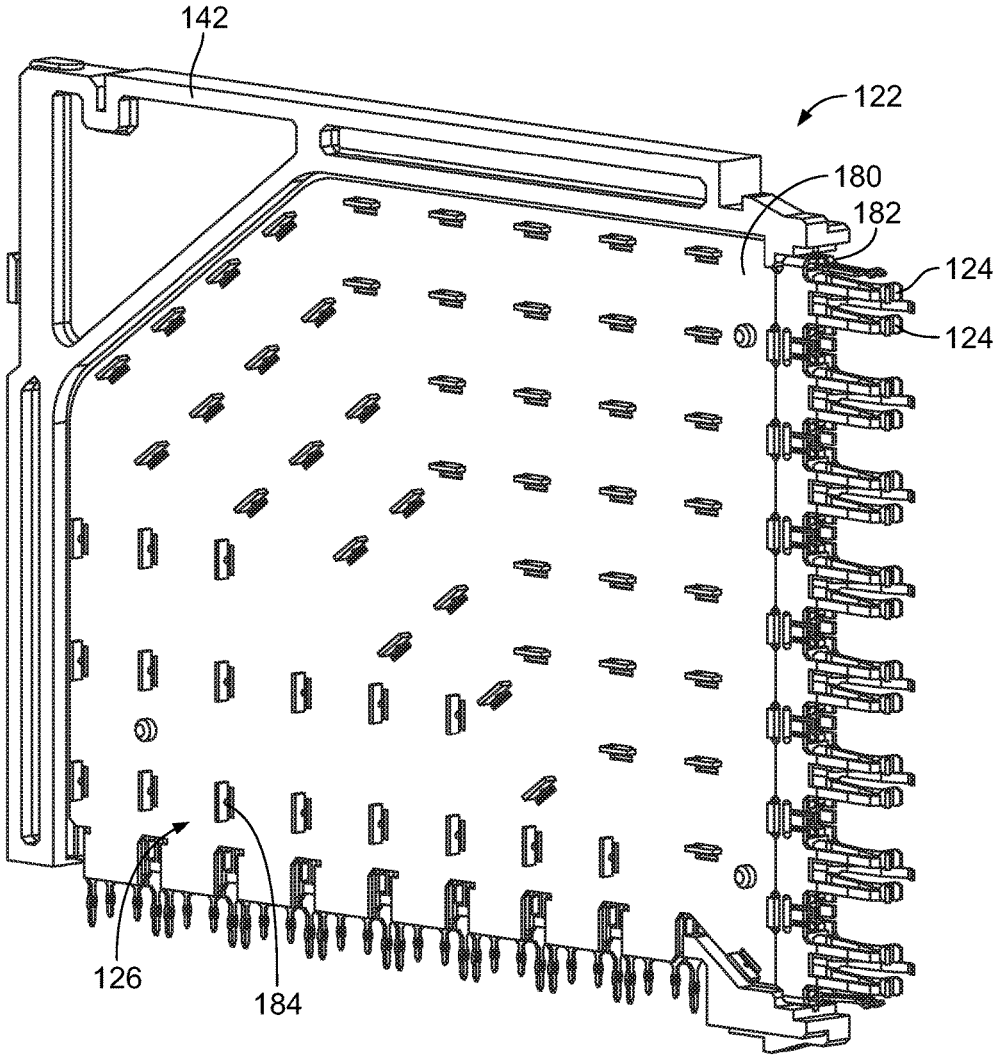
FIG. 2 is a perspective view of a contact module of an electrical connector of the electrical connector system in accordance with an exemplary embodiment.

FIG. 2 is a perspective view of one of the contact modules 122 in accordance with an exemplary embodiment. The contact module 122 includes a frame assembly having the signal contacts 124 in a dielectric holder 142. The shield structure 126 is held by and/or configured to be coupled to the dielectric holder 142 to provide electrical shielding for the signal contacts 124. The shield structure 126 provides shielding for the signal contacts 124 along substantially the entire lengths of the signal contacts 124. In an exemplary embodiment, portions of the shield structure 126 are at least partially enclosed in the dielectric holder, while other portions of the shield structure 126 are coupled to the exterior of the dielectric holder 142.

In an exemplary embodiment, the shield structure 126 includes first and second ground shields 180, 182 and ground skewers 184 used to electrically connect the first and second ground shields 180, 182. In the illustrated embodiment, the ground skewers 184 are separate and discrete from the ground shields 180, 182. For example, the ground skewers 184 and the ground shields 180, 182 are each separately stamped and formed pieces configured to be mechanically and electrically connected together to form part of the shield structure 126. The ground skewers 184 are configured to be electrically connected to the ground shields 180, 182 to electrically common all of the components of the shield structure 126. In other various embodiments, the ground skewers 184 may be integral with (for example, stamped and formed with) the first ground shield 180 and/or the second ground shield 182.

Figure 3:
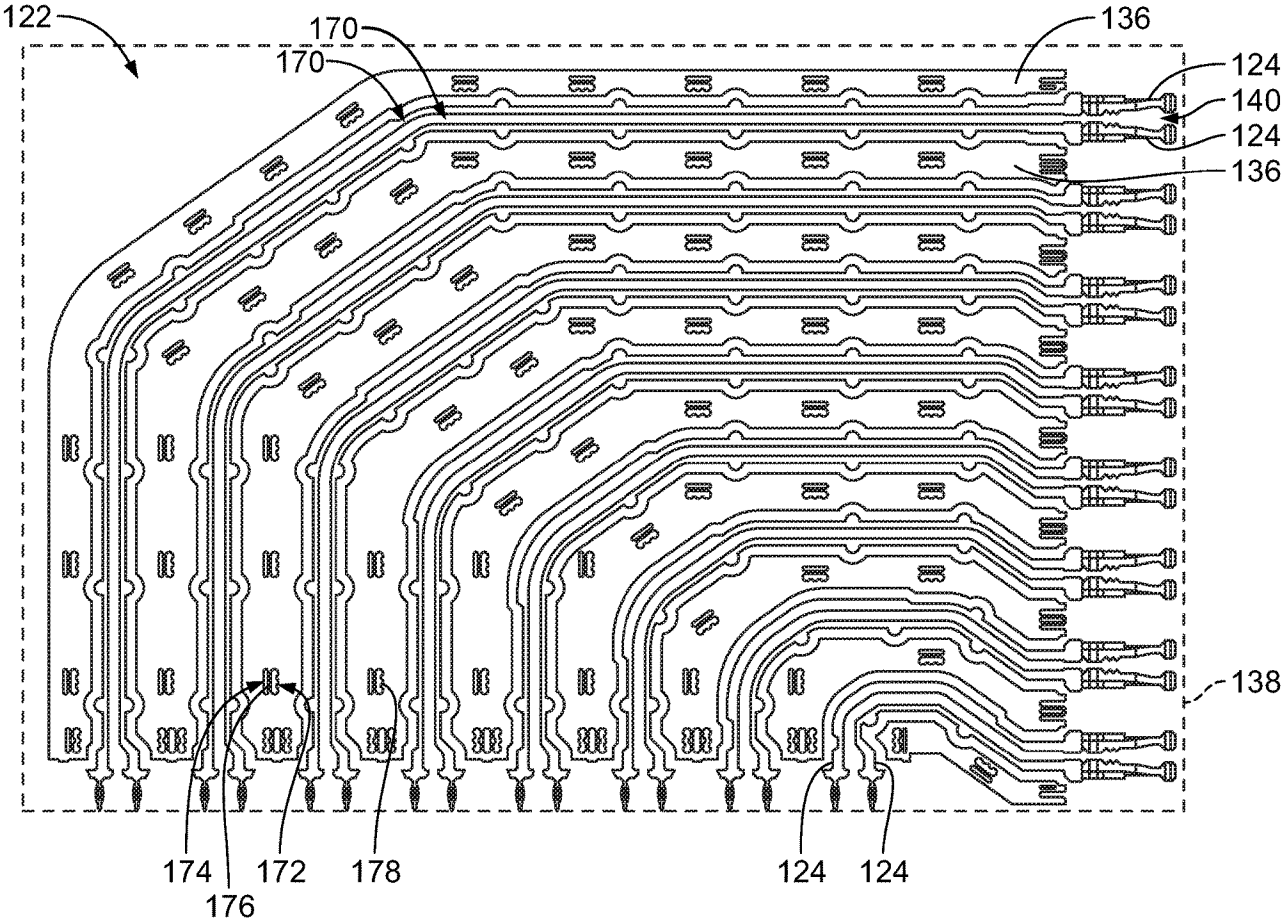
FIG. 3 is a perspective view of a portion of the contact module in accordance with an exemplary embodiment.

FIG. 3 is a perspective view of a portion of one of the contact modules 122 showing the signal contacts 124 and guard traces 136. The signal contacts 124 and guard traces 136 are arranged in an array in a contact plane 138. The guard traces 136 are arranged between corresponding signal contacts 124, such as between pairs 140 of the signal contacts 124. The guard traces 136 form part of the shield structure 126. The guard traces 136 are configured to be electrically connected to the first and second ground shields 180, 182 by the ground skewers 184 (shown in FIG. 2). The guard traces 136 provide electrical shielding between the signal contacts 124, such as between the pairs 140 of the signal contacts 124. In other various embodiments, the contact module 122 may be provided without the guard traces 136 between the signal contacts 124.

In an exemplary embodiment, the signal contacts 124 and the guard traces 136 are stamped and formed from a common sheet of metal, such as a leadframe. The guard traces 136 are coplanar with the signal contacts 124. Edges of the guard traces face edges of the signal contacts 124 with gaps therebetween. The gaps may be filled with dielectric material or air to electrically isolate the guard traces 136 from the signal contacts 124 when the contact module 122 is manufactured, such as by an overmolded dielectric body forming the dielectric holder 142 (shown in FIG. 2).

In an exemplary embodiment, the guard traces 136 include guard trace openings 172 therein configured to receive corresponding ground skewers 184. The guard traces 136 include relief slots 174 proximate to the guard traces openings 172 and relief beams 176 between the relief slots 174 and the guard traces openings 172. The relief beams 176 are deflectable into the relief slots 174 when the ground skewers 184 are loaded into the guard traces openings 172. For example, the ground skewers 184 may press outward against the relief beams 176 in an interference fit. In an exemplary embodiment, the guard traces 136 include protrusions 178 extending into the guard traces openings 172 to interface with the ground skewers 184 when the ground skewers 184 are received in the guard traces openings 172. The protrusions 178 may engage the ground skewers 184 by an interference fit. The ground skewers 184 are used to electrically common the guard traces 136 with other portions of the shield structure 126, such as the first and second ground shields 180, 182.

Figure 4:
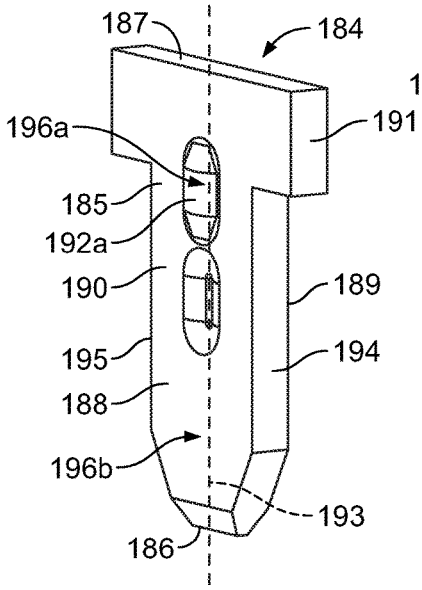
FIG. 4 is a front perspective view of a ground skewer of the contact module in accordance with an exemplary embodiment.
Figure 5:
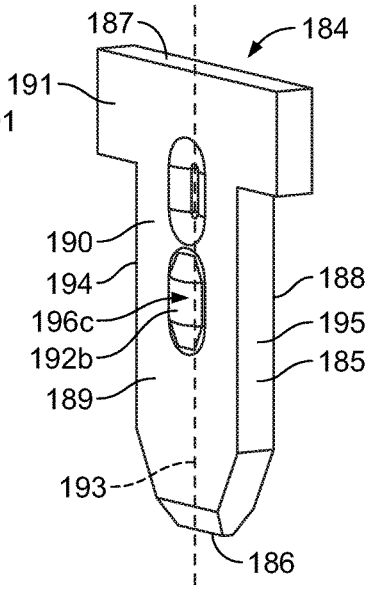
FIG. 5 is a rear perspective view the ground skewer in accordance with an exemplary embodiment.

FIG. 4 is a front perspective view of one of the ground skewers 184 in accordance with an exemplary embodiment. FIG. 5 is a rear perspective view of one of the ground skewers 184 in accordance with an exemplary embodiment. The ground skewer 184 includes a body 185 extending between a first end 186 and a second end 187. The body 185 of the ground skewer 184 includes a first side 188 and a second side 189. The body 185 is manufactured from a conductive material, such as a metal material. For example, the body 185 may be copper. In various embodiments, the body 185 may be plated or may be selectively plated. In the illustrated embodiment, the ground skewer 184 is a separate and discrete component being a single piece separate from other ground skewers 184 and ground shields 180, 182. In other various embodiments, the ground skewer 184 is integral with one of the ground shields, such as the first ground shield 180.

The ground skewer 184 includes a post 190 extending from a head 191. In the illustrated embodiment, the ground skewer 184 is a T-shaped; however, the ground skewer 184 may have other shapes in alternative embodiments. The head 191 is provided at the second end 187. The post 190 extends from the head 191 to the first end 186. Optionally, the distal end of the post 190, at the first end 186, may be chamfered for mating with the first and second ground shields 180, 182 and the guard traces 136.

In an exemplary embodiment, the ground skewer 184 includes one or more protrusions 192. In the illustrated embodiment, the ground skewer 184 includes a first protrusion 192*a* extending from the first side 188 and a second protrusion 192*b* extending from the second side 189. Optionally, the protrusions 192 may be aligned along a post axis 193 of the post 190. Alternatively, the protrusions 192 may be offset relative to each other, such as closer to a first edge 194 or a second edge 195 of the post 190. The protrusions 192 are configured to engage other portions of the shield structure 126, such as the first ground shield 180 and/or the second ground shield 182 and/or the guard trace 136.

In an exemplary embodiment, the ground skewer 184 includes multiple mating interfaces 196. The mating interfaces 196 are configured to engage other portions of the shield structure 126, such as the first ground shield 180, second ground shield 182 and the guard trace 136. In various embodiments, the protrusions 192 define mating interfaces 196. In various embodiments, the mating interfaces 196 may be provided at the first side 188 and/or the second side 189. In other various embodiments, the mating interfaces 196 may be provided at the first edge 194 and/or the second edge 195. In an exemplary embodiment, the ground skewer 184 includes mating interfaces 196*a*, 196*b*, 196*c* for each of the first ground shield 180, the second ground shield 182 and the guard trace 136, respectively. The mating interfaces 196 may be positioned at other locations in alternative embodiments.

Figure 6:
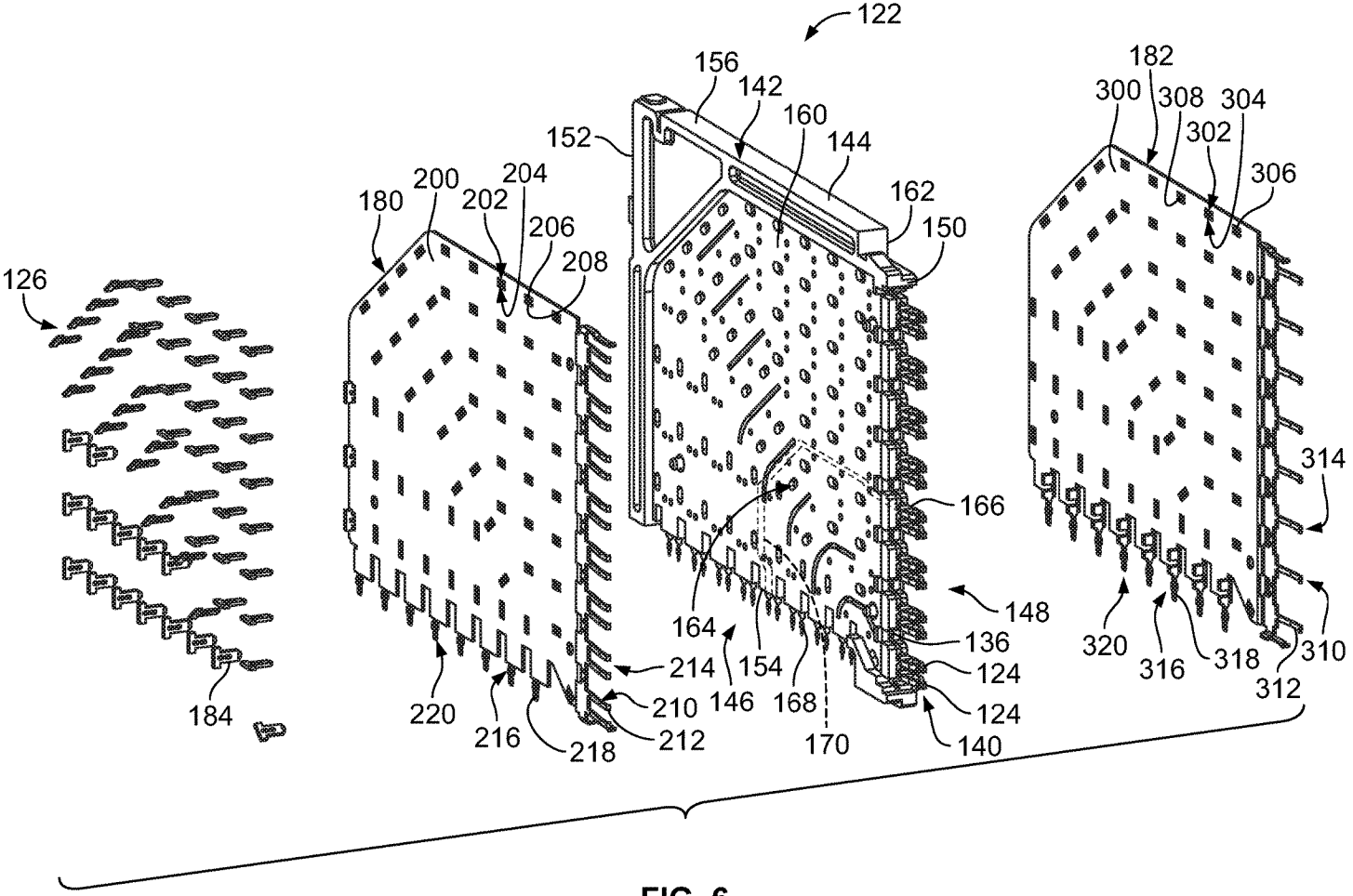
FIG. 6 is an exploded view of the contact module in accordance with an exemplary embodiment.

FIG. 6 is an exploded view of one of the contact modules 122 in accordance with an exemplary embodiment. The contact module 122 includes a frame assembly having the signal contacts 124 and guard traces 136 with the dielectric holder 142 holding the signal contacts 124 and the guard traces 136. The dielectric holder 142 generally surrounds the signal contacts 124 and the guard traces 136 along substantially the entire lengths thereof between a mounting end 146 at the bottom and a mating end 148 at the front. The shield structure 126 is held by and/or configured to be coupled to the dielectric holder 142 to provide electrical shielding for the signal contacts 124.

The dielectric holder 142 is formed from a dielectric body 144 at least partially surrounding the signal contacts 124 and the guard traces 136. The dielectric body 144 may be overmolded over the signal contacts 124 and the guard traces 136. Portions of the signal contacts 124 and the guard traces 136 are encased in the dielectric body 144. The dielectric holder 142 has a front 150 configured to be loaded into the housing 120 (shown in FIG. 1), a rear 152 opposite the front 150, a bottom 154 which optionally may be adjacent to the circuit board 104 (shown in FIG. 1), and a top 156 generally opposite the bottom 154. The dielectric holder 142 also includes first and second sides 160, 162, such as a right side 160 and a left side 162. In an exemplary embodiment, the dielectric body 144 includes a plurality of openings 164 configured to receive the ground skewers 184. The openings 164 expose the guard traces 136 to allow the ground skewers 184 to mate with the guard traces 136.

In an exemplary embodiment, portions of the shield structure 126 (such as the guard traces 136) are at least partially encased in the dielectric body 144, while other portions of the shield structure 126 are coupled to the exterior of the dielectric body 144, such as the right side 160 and/or the left side 162 of the dielectric holder 142. In the illustrated embodiment, the guard traces 136 are arranged along the contact plane 138 (shown in FIG. 3) between, and optionally parallel to, the first and second sides 160, 162. Additionally, in the illustrated embodiment, portions of the shield structure 126, such as the first and second ground shields 180, 182, are coupled to both the right and left sides 160, 162.

Each signal contact 124 has a mating portion 166 extending forward from the front 150 of the dielectric holder 142, and a mounting portion 168 extending downward from the bottom 154. Each signal contact 124 has a transition portion 170 (shown in FIG. 3) between the mating and mounting portions 166, 168. The transition portions 170 each include a top, a bottom, a right side, and a left side. In an exemplary embodiment, the top of the outermost signal contact 124 within the pair 140 and the bottom of the innermost signal contact 124 with the pair 140 are shielded from signal contacts 124 of the adjacent pair 140 by the guard traces 136. The right side of each signal contact 124 is covered by the shield structure 126 to shield the signal contacts 124 from signal contacts 124 in an adjacent contact module 122. The mating portions 166 are configured to be electrically terminated to corresponding mating signal contacts 112 (shown in FIG. 1) when the electrical connector 102 is mated to the mating electrical connector 106 (shown in FIG. 1). In an exemplary embodiment, the mounting portions 168 include compliant pins, such as eye-of-the-needle pins, configured to be terminated to the circuit board 104 (shown in FIG. 1).

In an exemplary embodiment, the shield structure 126 includes the guard traces 136, the first and second ground shields 180, 182 and the ground skewers 184. In the illustrated embodiment, the ground shields 180, 182 and the ground skewer 184 are each separate stamped and formed pieces configured to be mechanically and electrically connected together to form part of the shield structure 126. The ground shields 180, 182 and/or the ground skewer 184 are configured to be electrically connected to the guard traces 136 to electrically common all of the components of the shield structure 126. The ground skewers 184 electrically connect the first ground shield 180 to the guard traces 136. The ground skewers 184 electrically connect the first ground shield 180 to the second ground shield 182. The ground skewers 184 electrically connect the second ground shield 182 to the guard traces 136. In various embodiments, the ground skewers 184 may be integral with (for example, stamped and formed with) the first ground shield 180 and/or the second ground shield 182. When assembled, the first ground shield 180 is positioned along the right side 160 of the dielectric holder 142 and the second ground shield 182 is positioned along the left side 162 of the dielectric holder 142. The ground skewer 184 pass through the dielectric holder 142 to connect to the guard traces 136 and the connect the first and second ground shields 180, 182. The ground shields 180, 182 electrically connect the contact module 122 to the mating electrical connector 106, such as to the mating ground shields 114 thereof (shown in FIG. 1), thereby electrically commoning the connection between the electrical connector 102 and the mating electrical connector 106. The ground shields 180, 182 electrically connect the contact module 122 to the circuit board 104, such as through compliant pins thereof.

The ground shield 180 is stamped and formed from a stock piece of metal material. In an exemplary embodiment, the ground shield 180 includes a panel 200 configured to extend along the right side 160 of the dielectric holder 142. The panel 200 includes skewer openings 202 that receive corresponding ground skewers 184. In an exemplary embodiment, the panel 200 includes relief slots 204 adjacent the skewer openings 202 and relief beams 206 between the relief slots 204 and the skewer openings 202. The relief beams 206 are elastically deformed against the ground skewers 184 when the ground skewers are loaded into the skewer openings 202. The relief beams 206 are flexed outward into the relief slots 204 by the ground skewers 184. The relief beams 206 engage the ground skewers 184 by an interference or compression fit when the ground skewers 184 are loaded in the skewer openings 202. Optionally, the panel 200 may include shield protrusions 208 extending into the skewer opening 202 to interfere with and engage the ground skewer 184 when the ground skewer 184 is loaded into the skewer opening 202. The shield protrusions 208 may be provided along the relief beams 206. The shield protrusions 208 may additionally or alternatively be provided on opposite sides of the skewer opening 202 from the relief beams 206 in other various embodiments.

The ground shield 180 includes mating portions 210 defined by mating beams 212 at a mating end 214 of the panel 200. The mating portions 210 are configured to be mated with corresponding mating portions of the mating electrical connector 106 (for example, the C-shaped mating ground shields 114, shown in FIG. 1). The mating beams 212 may be deflectable mating beams, such as spring beams. Optionally, the mating beams 212 are configured to be received inside the corresponding C-shaped mating ground shields 114 of the mating electrical connector 106. Alternatively, the mating beams 212 are configured to extend along the outside of the corresponding C-shaped mating ground shields 114 of the mating electrical connector.

The ground shield 180 includes mounting portions 216 defined by compliant pins 218 at a mounting end 220 of the panel 200. The mounting portions 216 are configured to be terminated to the circuit board 104 (shown in FIG. 1). For example, the mounting portions 216 are configured to be press-fit in plated vias in the circuit board 104.

The second ground shield 182 is stamped and formed from a stock piece of metal material. The ground shield 182 includes a panel 300 configured to extend along the left side 162 of the dielectric holder 142. The panel 300 may be generally planar and configured to attach to the front 150 of the dielectric holder 142; however, the panel 300 may extend between the mating end 148 and the mounting end 146 in other various embodiments, similar to the first ground shield 180. The panel 300 includes skewer openings 302 that receive corresponding ground skewers 184. In an exemplary embodiment, the panel 300 includes relief slots 304 adjacent the skewer openings 302 and relief beams 306 between the relief slots 304 and the skewer openings 302. The relief beams 306 are elastically deformed against the ground skewers 184 when the ground skewers 184 are loaded into the skewer openings 302. The relief beams 306 are flexed outward into the relief slots 304 by the ground skewers 184. The relief beams 306 engage the ground skewers 184 by an interference or compression fit when the ground skewers 184 are loaded in the skewer openings 302. Optionally, the panel 300 may include shield protrusions 308 extending into the skewer opening 302 to interfere with and engage the ground skewer 184 when the ground skewer 184 is loaded into the skewer opening 302. The shield protrusions 308 may be provided along the relief beams 306. The shield protrusions 308 may additionally or alternatively be provided on opposite sides of the skewer opening 302 from the relief beams 306 in other various embodiments.

The ground shield 182 includes mating portions 310 defined by mating beams 312 at a mating end 314 of the panel 300. The mating portions 310 are configured to be mated with corresponding mating portions of the mating electrical connector (for example, the C-shaped mating ground shields 114, shown in FIG. 1). In an exemplary embodiment, the mating beams 312 are side mating beams configured to extend along the sides of the corresponding signal contacts 124; however the mating beams 312 may extend along other portions of the signal contacts 124. The mating beams 312 may be deflectable mating beams, such as spring beams. Optionally, the mating beams 312 are configured to be received inside the corresponding C-shaped mating ground shields 114 of the mating electrical connector 106. Alternatively, the mating beams 312 are configured to extend along the outside of the corresponding C-shaped mating ground shields 114 of the mating electrical connector.

The ground shield 182 includes mounting portions 316 defined by compliant pins 318 at a mounting end 320 of the panel 300. The mounting portions 316 are configured to be terminated to the circuit board 104 (shown in FIG. 1). For example, the mounting portions 316 are configured to be press-fit in plated vias in the circuit board 104.

Figure 7:
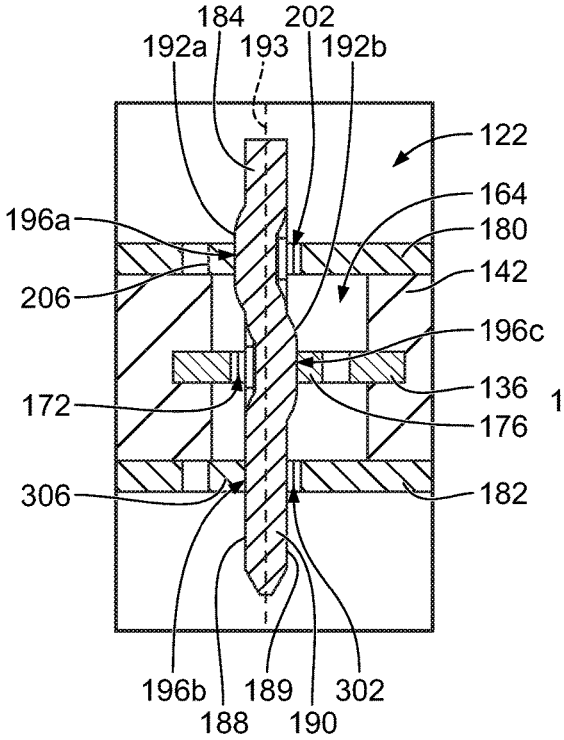
FIG. 7 is a cross-sectional view of a portion of the contact module showing the ground skewer electrically coupled to ground shields and a guard trace of the contact module in accordance with an exemplary embodiment.

FIG. 7 is a cross-sectional view of a portion of the contact module 122 showing the ground skewer 184 electrically coupled to the first and second ground shields 180, 182 and the guard trace 136. The ground skewer 184 is received in the opening 164 in the dielectric holder 142. The ground skewer 184 interfaces with the guard trace 136 to electrically common the guard trace 136 with the first and second ground shields 180, 182. In other various embodiments, the contact module 122 may be provided without the guard trace 136, in which case, the ground skewer 184 electrically connects the first and second ground shields 180, 182 without electrically connected to a guard trace 136.

The ground skewer 184 is connected to the contact module 122 to electrically connect with the first ground shield 180, the second ground shield 182 and the guard trace 136. In the illustrated embodiment, the first mating interface 196*a* is electrically connected to the first ground shield 180 at the skewer opening 202. For example, the protrusion 192 engages the relief beam 206 to electrically connect the ground skewer 184 to the first ground shield 180. The second mating interface 196*b* is electrically connected to the second ground shield 182 at the skewer opening 302. For example, the post 190 engages the relief beam 306 to electrically connect the ground skewer 184 to the second ground shield 182. The third mating interface 196*c* is electrically connected to the guard trace 136 at the guard trace opening 172. For example, the protrusion 192 engages the relief beam 176 to electrically connect the ground skewer to the guard trace 136.

In an exemplary embodiment, the mating interfaces 196 are laterally offset relative to each other along the post axis 193. For example, the first mating interface 196*a* is laterally offset relative to the second mating interface 196*b* and the third mating interface 196*c*. For example, the first protrusion 192*a* is shifted to one side such that the first mating interface 196 is offset outward relative to the first side 188. Similarly, the second mating interface 196*b* is laterally offset relative to the first mating interface 196*a* and the third mating interface 196*c*. For example, the second mating interface 196*b* is located at the first side 188, which is offset relative to the first protrusion 192*a* and the second protrusion 192*b*. Similarly, the third mating interface 196*c* is laterally offset relative to the first mating interface 196*a* and the second mating interface 196*b*. For example, the second protrusion 192*b* is shifted to one side, which may be opposite to the side that the first protrusion 192*a* is shifted, such that the third mating interface 196*c* is offset outward relative to the second side 189.

When the post 190 of the ground skewer 184 is loaded into the contact module 122, the distal end of the post 190 freely passes through the skewer opening 202 in the first ground shield 180 and freely passes through the guard trace opening 172 and the guard trace 136 before engaging the second ground shield 182 at the skewer opening 302. As such, the distal end of the post 190 does not wipe against the first ground shield 180 or the guard trace 136 during loading, which reduces the risk of damage to the coating on the ground skewer 184 or the first ground shield 180 or the guard trace 136. If wiping does occur during loading, the wiping may occur on the second side 189 as opposed to occurring on the first side 188 at the location of the second mating interface 196*b*. Similarly, the skewer opening 202 in the first ground shield 180 is located to allow the second protrusion 192*b* to pass therethrough without wiping of the third mating interface 196*c*.

Figure 8:
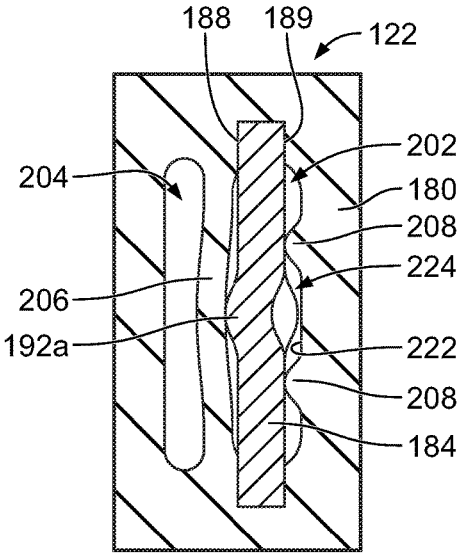
FIG. 8 is a cross-sectional view of a portion of the contact module showing the ground skewer interfacing with the first ground shield in accordance with an exemplary embodiment.
Figure 9:
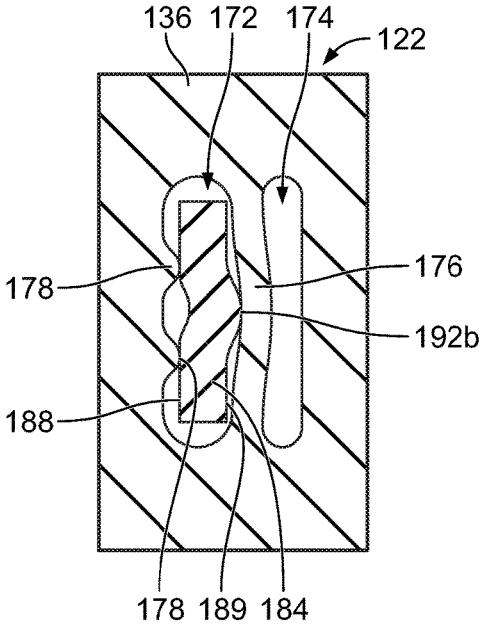
FIG. 9 is a cross-sectional view of a portion of the contact module showing the ground skewer interfacing with the guard trace in accordance with an exemplary embodiment.
Figure 10:
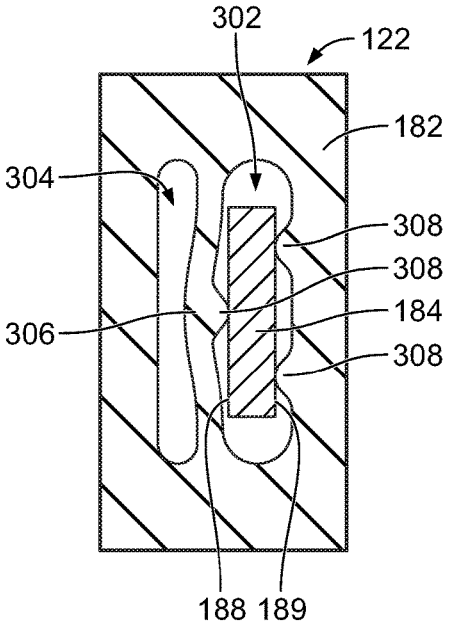
FIG. 10 is a cross-sectional view of a portion of the contact module showing the ground skewer interfacing with the second ground shield in accordance with an exemplary embodiment.

FIG. 8 is a cross-sectional view of a portion of the contact module 122 showing the ground skewer 184 interfacing with the first ground shield 180. FIG. 9 is a cross-sectional view of a portion of the contact module 122 showing the ground skewer 184 interfacing with the guard trace 136. FIG. 10 is a cross-sectional view of a portion of the contact module 122 showing the ground skewer 184 interfacing with the second ground shield 182.

In an exemplary embodiment, the first ground shield 180 (FIG. 8) includes one or more of the shield protrusions 208 extending into the skewer opening 202. In the illustrated embodiment, the shield protrusions 208 are located along an edge 222 defining the skewer opening 202 opposite the relief beam 206. The shield protrusions 208 engage the second side 189 of the ground skewer 184 to press the ground skewer 184 toward the relief beam 206. Optionally, a pair of the shield protrusions 208 are provided and offset from each other to form a gap 224 therebetween that allows the second protrusion 192*b* to pass through the gap 224 during loading of the ground skewer 184 into the contact module 122. The first protrusion 192*a* extends from the first side 188 to interface with the relief beam 206 and flex the relief beam 206 outward into the relief slot 204. In an exemplary embodiment, the first protrusion 192*a* defines a point of contact with the first ground shield 180 and the shield protrusions 208 define point of contact with the ground skewer 184 to electrically connect the ground skewer 184 to the first ground shield 180.

In an exemplary embodiment, the guard trace 136 (FIG. 9) includes one or more of the protrusions 178 extending into the guard trace opening 172. The protrusions 178 engage the first side 188 of the ground skewer 184 to press the ground skewer 184 toward the relief beam 176. The second protrusion 192*b* extends from the second side 189 to interface with the relief beam 176 and flex the relief beam 176 outward into the relief slot 174. In an exemplary embodiment, the second protrusion 192*b* defines a point of contact with the guard trace 136 and the protrusions 178 define points of contact with the ground skewer 184 to electrically connect the ground skewer 184 to the guard trace 136.

In an exemplary embodiment, the second ground shield 182 (FIG. 10) includes one or more of the shield protrusions 308 extending into the skewer opening 302. In the illustrated embodiment, the shield protrusions 308 are located along both sides of the skewer opening 302. The shield protrusions 308 engage the first side 188 and the second side 189 of the ground skewer 184 to engage the ground skewer 184. The shield protrusions 308 define points of contact with the ground skewer 184 to electrically connect the ground skewer 184 to the second ground shield 182.

Figure 11:
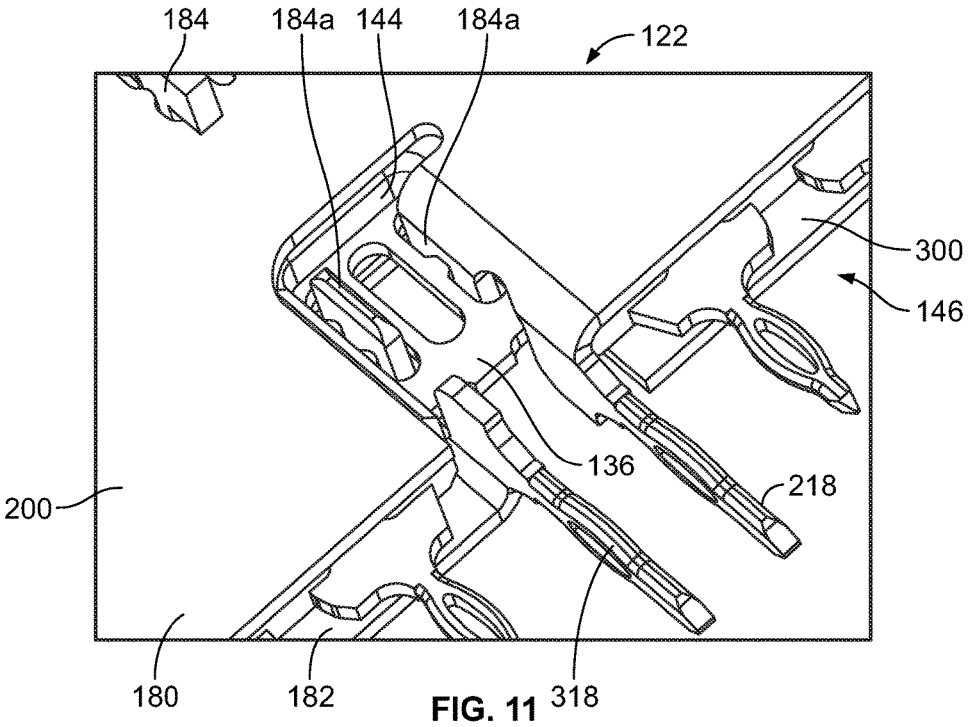
FIG. 11 is a perspective view of a portion of the contact module in accordance with an exemplary embodiment.

FIG. 11 is a perspective view of a portion of the contact module 122 showing the mounting end 146 of the contact module 122. The first and second ground shields 180, 182 include ground skewers 184*a* bent perpendicular from the panels 200, 300 into the dielectric body 144. The ground skewers 184*a* are mechanically and electrically connected to the corresponding guard trace 136. The ground skewers 184*a* are associated with the corresponding compliant pins 218, 318 being stamped and formed with the compliant pins 218, 318 and bent inward perpendicular to the panels 200, 300. However, in alternative embodiments, the first and second ground shields 180, 182 may be provided without the ground skewers 184*a*, but rather include the separate and discrete ground skewers 184.

Figure 12:
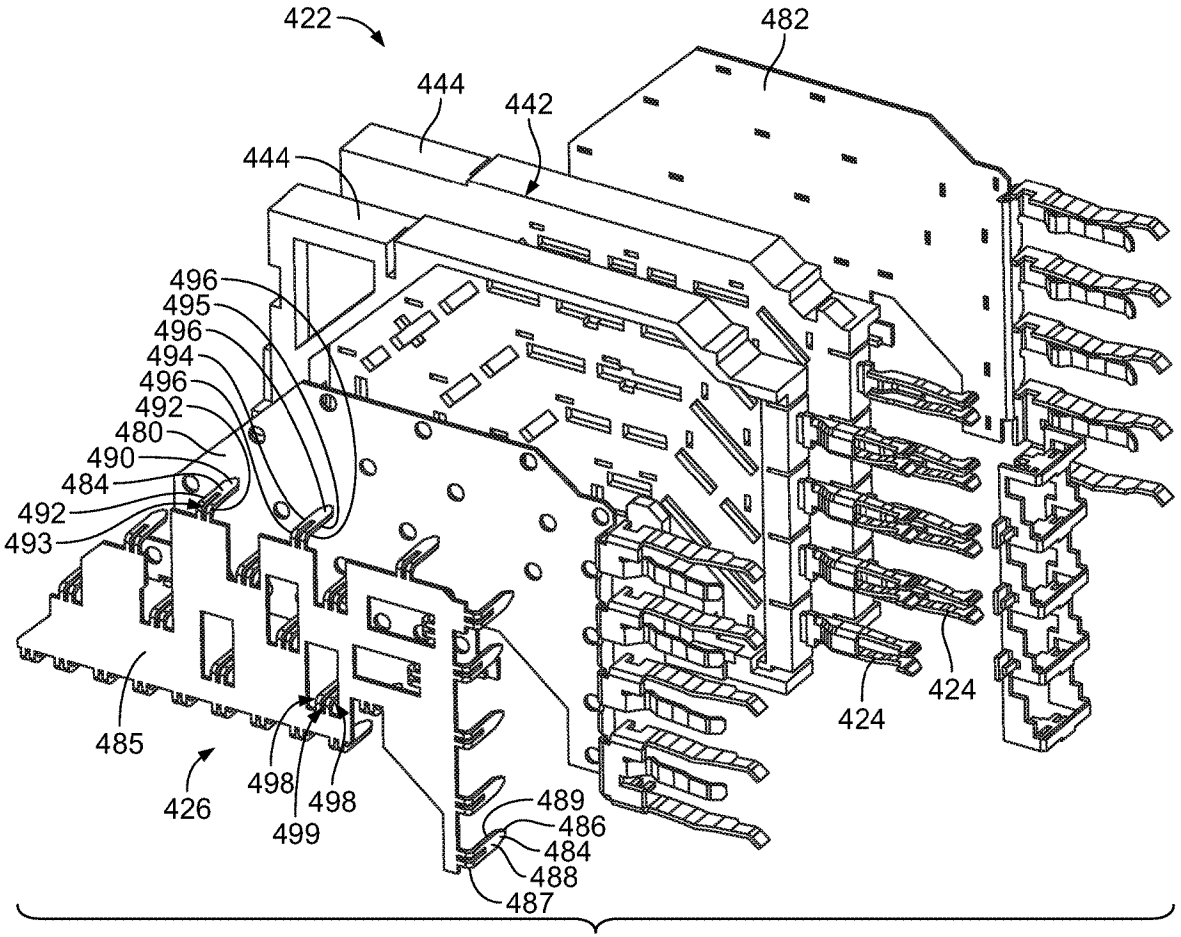
FIG. 12 is a perspective view of a contact module in accordance with an exemplary embodiment.

FIG. 12 is a perspective view of a contact module 422 in accordance with an exemplary embodiment. The contact module 422 is similar to the contact module 122 and may be used in place of the contact module 122; however, the contact module 422 has a different shield structure 426 than the contact module 122. In an exemplary embodiment, the contact module 422 includes ground skewers that are integral with each other as part of a skewer plate coupled to the ground shields rather than being separate and discrete pieces.

The contact module 422 includes a frame assembly having signal contacts 424 in a dielectric holder 442. The shield structure 426 includes first and second ground shields 480, 482 coupled to the dielectric holder 442. The shield structure 426 includes ground skewers 484 integral with a skewer plate 485. The skewer plate 485 is coupled to the first ground shield 480 and the second ground shield 482 to electrically connect the first ground shield 480 to the second ground shield 482. The ground skewers 484 are stamped from the skewer plate 485 and bent perpendicular to the skewer plate 485 to extend into the dielectric holder 442 and the first and second ground shields 480, 482. The ground skewers 484 are configured to be electrically connected to the ground shields 480, 482 to electrically common all of the components of the shield structure 426.

Each ground skewer 484 includes a post 490 extending between a first end 486 and a second end 487. The post 490 is stamped from the skewer plate 485 and bent perpendicular to the skewer plate 485. The post 490 of the ground skewer 484 includes a first side 488 and a second side 489. The post 490 is manufactured from a conductive material, such as a metal material. For example, the post 490 may be copper. In various embodiments, the post 490 may be plated or may be selectively plated.

In an exemplary embodiment, the ground skewer 484 includes one or more protrusions 492 configured to engage other portions of the shield structure 426, such as the first ground shield 480 and/or the second ground shield 482 and/or the guard trace. In the illustrated embodiment, the protrusions 492 are defined by a compliant portion 493 having bulged sections 498 with a relief slot 499 adjacent the bulged sections 498. The compliant portion 493 may be a compliant pin, such as an eye-of-the-needle pin. For example, the relief slot 499 may be in the middle of the post 490 with the bulged sections 498 on opposite sides of the relief slot 499.

In an exemplary embodiment, the ground skewer 484 includes multiple mating interfaces 496. The mating interfaces 496 are configured to engage other portions of the shield structure 426, such as the first ground shield 480, the second ground shield 482 and the guard trace. In various embodiments, the bulged sections 498 define mating interfaces 496. In various embodiments, the mating interfaces 496 may be provided at the first side 488 and/or the second side 489. In other various embodiments, the mating interfaces 496 may be provided at a first edge 494 and/or a second edge 495. The mating interfaces 496 may be positioned at other locations in alternative embodiments.

In an exemplary embodiment, the contact module 422 includes a multi-piece frame assembly having the signal contacts 424 and guard traces (not shown) within a pair of dielectric bodies 444. The dielectric bodies 444 surrounds the signal contacts 424 and the guard traces and are coupled together to form the contact module 422. The ground shields 480, 482 and the skewer plate 485 are coupled to the sides of the dielectric bodies 444.

Figure 13:
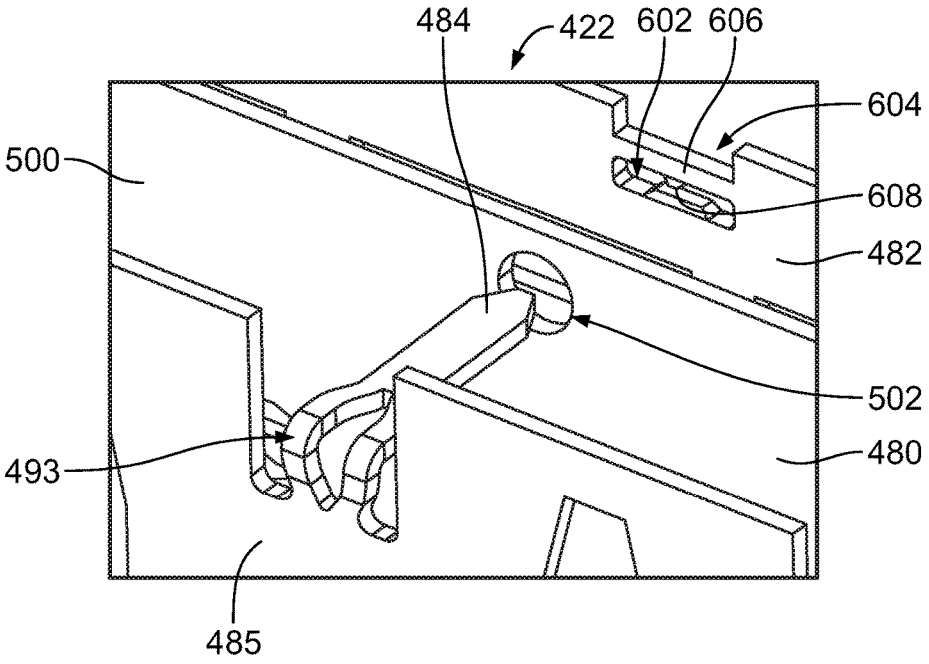
FIG. 13 is an enlarged view of a portion of the contact module in accordance with an exemplary embodiment.
Figure 14:
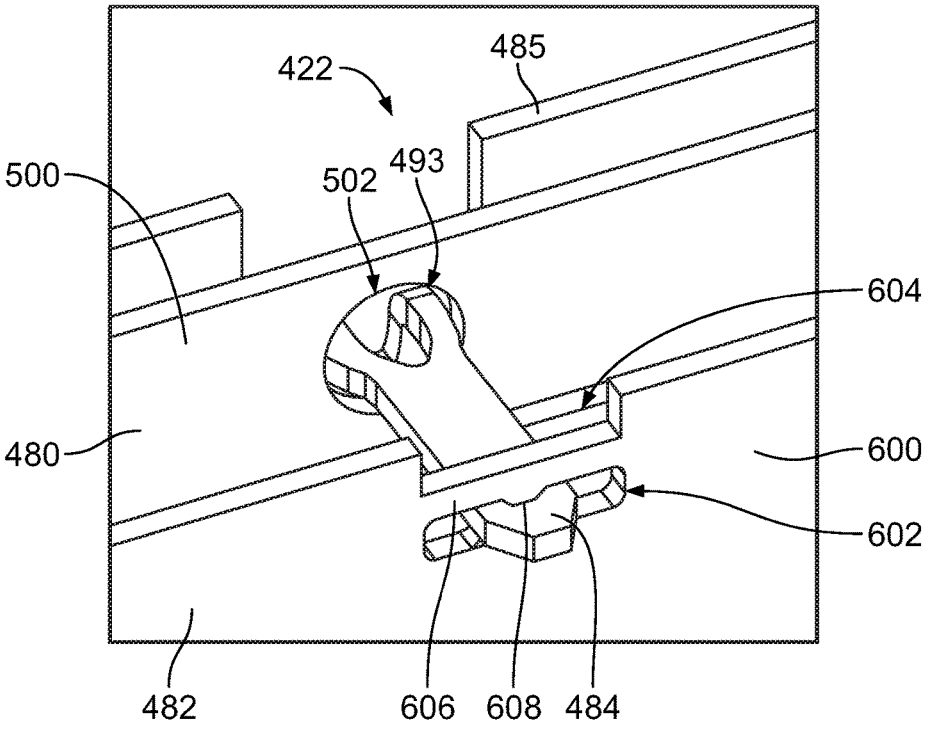
FIG. 14 is an enlarged view of a portion of the contact module in accordance with an exemplary embodiment.

FIG. 13 is an enlarged view of a portion of the contact module 422 in accordance with an exemplary embodiment. FIG. 14 is an enlarged view of a portion of the contact module 422 in accordance with an exemplary embodiment. FIGS. 13 and 14 show the first and second ground shields 480, 482 and the skewer plate 485 with the dielectric holder 142 removed to illustrate the connection between the ground skewers 484 and the ground shields 480, 482.

The first ground shield 480 is stamped and formed from a stock piece of metal material. In an exemplary embodiment, the ground shield 480 includes a panel 500. The panel 500 includes skewer openings 502 that receive corresponding ground skewers 484. The ground skewers 484 engage the edges of the panel 500 defining the skewer openings 502 by an interference or compression fit when the ground skewers 484 are loaded in the skewer openings 502. For example, the compliant portion 493 is loaded into the skewer opening 502 to engage the first ground shield 480.

The second ground shield 482 is stamped and formed from a stock piece of metal material. The ground shield 482 includes a panel 600. The panel 600 includes skewer openings 602 that receive corresponding ground skewers 484. In an exemplary embodiment, the panel 600 includes relief slots 604 adjacent the skewer openings 602 and relief beams 606 between the relief slots 604 and the skewer openings 602. The relief beams 606 are elastically deformed against the ground skewers 484 when the ground skewers 484 are loaded into the skewer openings 602. The relief beams 606 are flexed outward into the relief slots 604 by the ground skewers 484. The relief beams 606 engage the ground skewers 484 by an interference or compression fit when the ground skewers 484 are loaded in the skewer openings 602. Optionally, the panel 600 may include shield protrusions 608 extending into the skewer opening 602 to interfere with and engage the ground skewer 484 when the ground skewer 484 is loaded into the skewer opening 602. The shield protrusions 608 may be provided along the relief beams 606. The shield protrusions 608 may additionally or alternatively be provided on opposite sides of the skewer opening 602 from the relief beams 606 in other various embodiments. The first ground shield 480 may include similar types of skewer openings as the skewer openings 602 in alternative embodiments.

Figure 15:
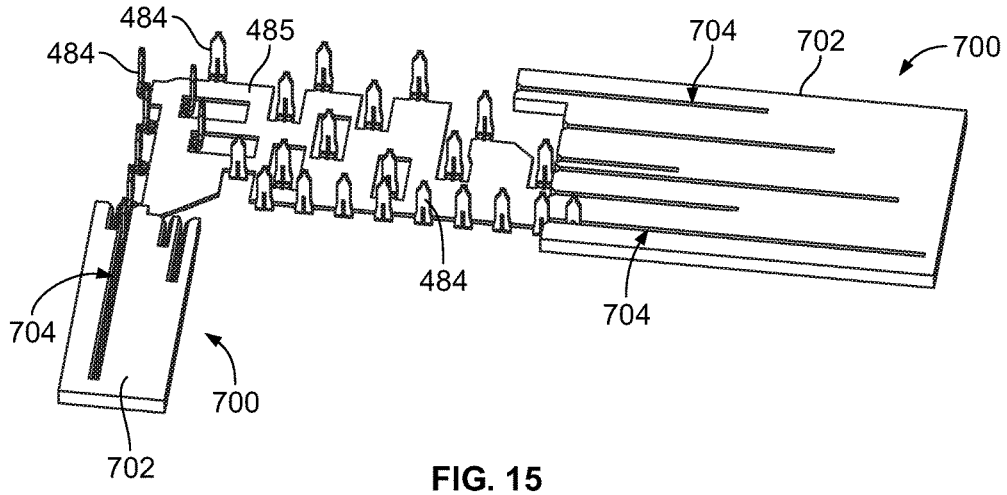
FIG. 15 illustrates a skewer organizer in accordance with an exemplary embodiment.
Figure 16:
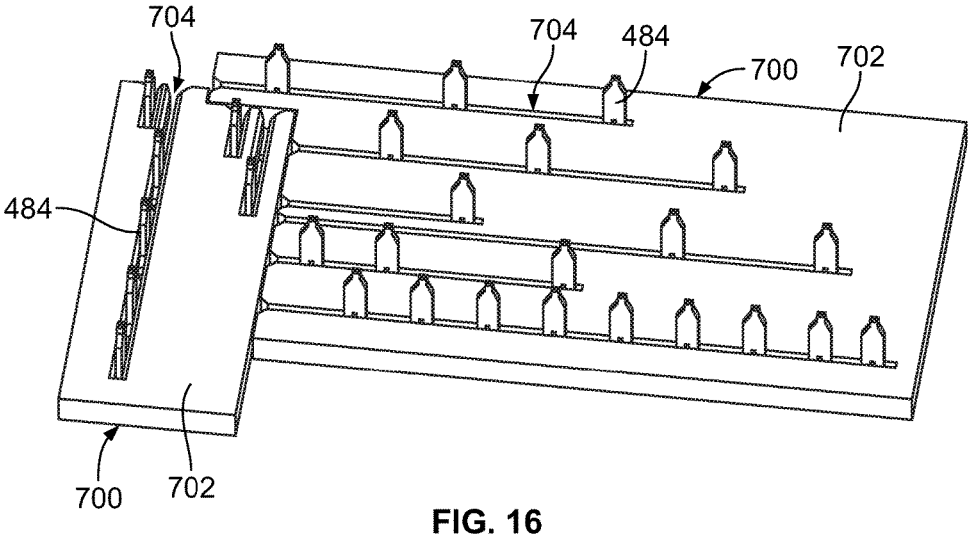
FIG. 16 illustrates the skewer organizer in accordance with an exemplary embodiment.

FIGS. 15 and 16 illustrates a skewer organizer 700 that may be used to hold the ground skewers 484 for mating the ground skewers 484 with the contact module 422 (FIG. 12). FIG. 15 illustrates the skewer organizer 700 partially assembled with the skewer plate 485 and the ground skewers 484. FIG. 16 illustrates the skewer organizer 700 fully loaded onto the skewer plate 485 and the ground skewers 484. The skewer organizer 700 includes one or more organizer blocks 702 having slots 704 that receive corresponding ground skewers 484. The organizer blocks 702 hold the relative positions of the ground skewers 484 to load the ends of the ground skewers 484 into the first ground shield 480. Once the ground skewers 484 are positioned in the first ground shield 480, the organizer blocks 702 may be removed to allow the skewer plate 485 to be fully loaded onto the contact module 422.

Figure 17:
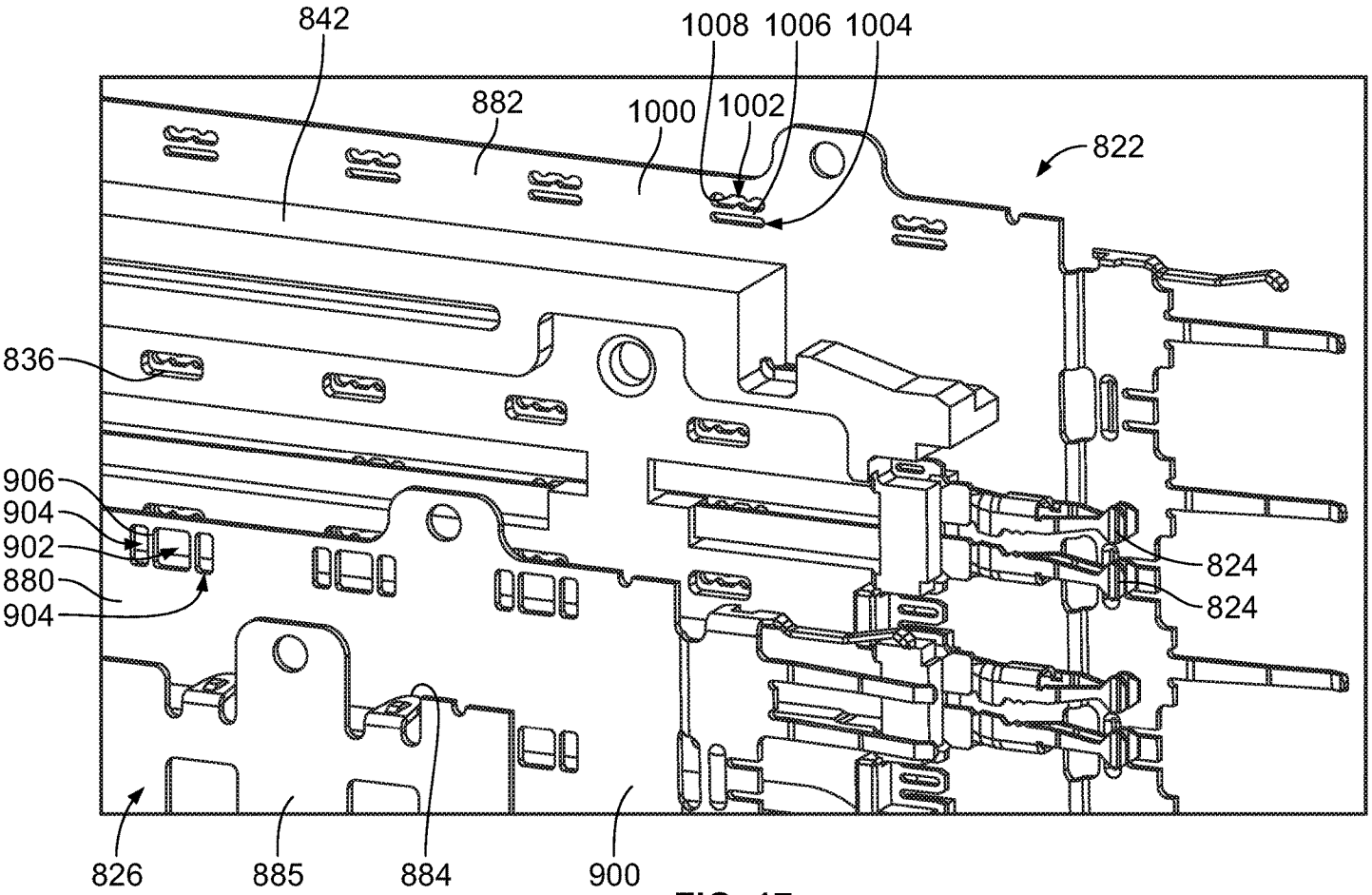
FIG. 17 is a perspective view of a contact module in accordance with an exemplary embodiment.

FIG. 17 is a perspective view of a contact module 822 in accordance with an exemplary embodiment. The contact module 822 is similar to the contact module 422. The contact module 822 includes a frame assembly having signal contacts 824 and guard traces 836 in a dielectric holder 842. The contact module 822 includes a shield structure 826 having first and second ground shields 880, 882 coupled to the dielectric holder 842. The shield structure 826 includes ground skewers 884 integral with a skewer plate 885. The skewer plate 885 is coupled to the first ground shield 880 and the second ground shield 882 to electrically connect the first ground shield 880 to the second ground shield 882. The ground skewers 884 are stamped from the skewer plate 885 and bent perpendicular to the skewer plate 885 to extend into the dielectric holder 842 and the first and second ground shields 880, 882. In an exemplary embodiment, the ground skewers 884 are terminated to the guard traces 836. The ground skewers 884 are configured to be electrically connected to the ground shields 880, 882 and the guard traces 836 to electrically common all of the components of the shield structure 826.

Figure 18:
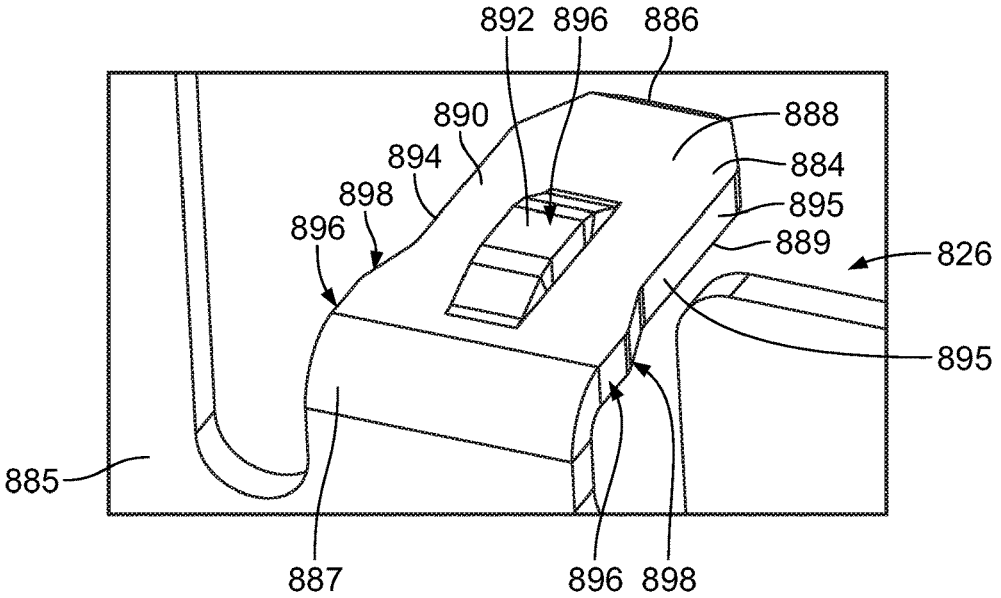
FIG. 18 is an enlarged view of a portion of a skewer plate of the contact module in accordance with an exemplary embodiment.

FIG. 18 is an enlarged view of a portion of the skewer plate 885 showing one of the ground skewers 884 in accordance with an exemplary embodiment. The ground skewer 884 includes a post 890 extending between a first end 886 and a second end 887. The post 890 is stamped from the skewer plate 885 and bent perpendicular to the skewer plate 885. The post 890 of the ground skewer 884 includes a first side 888 and a second side 889 and is manufactured from a conductive material, such as a metal material (e.g., copper). In various embodiments, the post 890 may be plated or may be selectively plated.

In an exemplary embodiment, the ground skewer 884 includes one or more protrusions 892 configured to engage other portions of the shield structure 826, such as the guard trace 836, the first ground shield 880 and/or the second ground shield 882. In the illustrated embodiment, the protrusions 892 are defined by bulged sections 898 along opposite edges 894, 895. The bulged sections 898 are wider than other portions of the post 890. The protrusions may be defined by a bulged section 898 along the first side 888. The protrusions 892 define mating interfaces 896 configured to engage other portions of the shield structure 826, such as the first ground shield 880, the second ground shield 882 and the guard trace 836. The mating interfaces 896 may be positioned at other locations in alternative embodiments. In an exemplary embodiment, the guard traces 836 include guard trace openings 872 that receive the ground skewers 884.

With reference back to FIG. 17, the first ground shield 880 is stamped and formed from a stock piece of metal material. In an exemplary embodiment, the ground shield 880 includes a panel 900. The panel 900 includes skewer openings 902 that receive corresponding ground skewers 884. In an exemplary embodiment, the panel 900 includes relief slots 904 adjacent the skewer openings 902 and relief beams 906 between the relief slots 904 and the skewer openings 902. The relief beams 906 are elastically deformed against the ground skewers 884 when the ground skewers 884 are loaded into the skewer openings 902. The relief beams 906 are flexed outward into the relief slots 904 by the ground skewers 884. The relief beams 906 engage the ground skewers 884 by an interference or compression fit when the ground skewers 884 are loaded in the skewer openings 902. Optionally, the panel 900 may include shield protrusions (not shown) extending into the skewer opening 902 to interfere with and engage the ground skewer 884 when the ground skewer 884 is loaded into the skewer opening 902.

The second ground shield 882 is stamped and formed from a stock piece of metal material. The ground shield 882 includes a panel 1000. The panel 1000 includes skewer openings 1002 that receive corresponding ground skewers 884. In an exemplary embodiment, the panel 1000 includes relief slots 1004 adjacent the skewer openings 1002 and relief beams 1006 between the relief slots 1004 and the skewer openings 1002. The relief beams 1006 are elastically deformed against the ground skewers 884 when the ground skewers 884 are loaded into the skewer openings 1002. The relief beams 1006 are flexed outward into the relief slots 1004 by the ground skewers 884. The relief beams 1006 engage the ground skewers 884 by an interference or compression fit when the ground skewers 884 are loaded in the skewer openings 1002. Optionally, the panel 1000 may include shield protrusions 1008 extending into the skewer opening 1002 to interfere with and engage the ground skewer 884 when the ground skewer 884 is loaded into the skewer opening 1002. The shield protrusions 1008 may be provided along the relief beams 1006. The shield protrusions 1008 may additionally or alternatively be provided on opposite sides of the skewer opening 1002 from the relief beams 1006 in other various embodiments. Optionally, the skewer openings 1002 may be oriented differently than the skewer openings 902, such as for engaging different areas or surfaces of the ground skewers 484.

Figure 19:
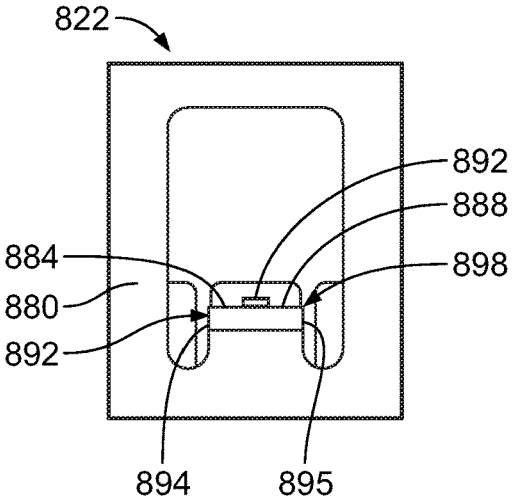
FIG. 19 is a cross-sectional view of a portion of the contact module in accordance with an exemplary embodiment.
Figure 20:
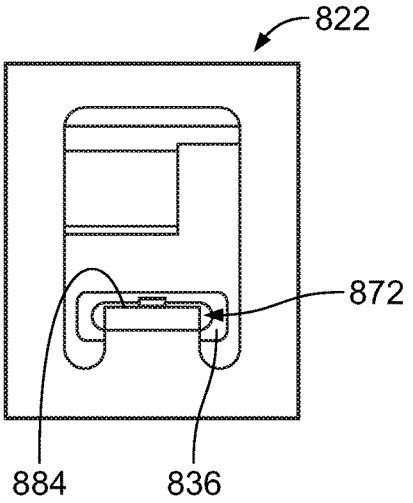
FIG. 20 is a cross-sectional view of a portion of the contact module in accordance with an exemplary embodiment.
Figure 21:
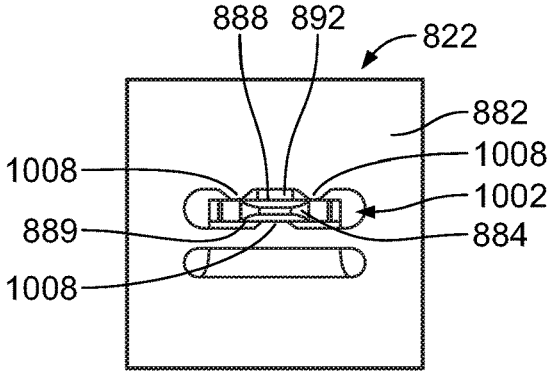
FIG. 21 is a cross-sectional view of a portion of the contact module in accordance with an exemplary embodiment.

FIG. 19 is a cross-sectional view of a portion of the contact module 822 showing the ground skewer 884 interfacing with the first ground shield 880. FIG. 20 is a cross-sectional view of a portion of the contact module 822 showing the ground skewer 884 interfacing with the guard trace 836. FIG. 21 is a cross-sectional view of a portion of the contact module 822 showing the ground skewer 884 interfacing with the second ground shield 882.

In an exemplary embodiment, the first ground shield 880 (FIG. 18) engages the first and second edges 894, 895 of the ground skewers 884, such as along the bulged sections 898. In an exemplary embodiment, the guard trace 836 (FIG. 19) receives the ground skewer 884 in the guard trace opening 872 to engage the protrusion 892 on the first side 888. In an exemplary embodiment, the second ground shield 882 (FIG. 20) receives the ground skewer 884 in the skewer opening 1002 such that the shield protrusions 1008 engage the first side 888 and the second side 889 of the ground skewer 884.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

What is claimed is:

1. A contact module comprising:

a dielectric holder having first and second sides extending between a mating end and a mounting end, the dielectric holder including dielectric holder openings embedded in the dielectric holder extending entirely through the dielectric holder between the first and second sides;

signal contacts held by the dielectric holder along a contact plane defined between the first and second sides, the signal contacts having mating portions extending from the mating end, mounting portions extending from the mounting end for termination to a circuit board, and transition portions extending through the dielectric holder between the mating and mounting portions;

a first ground shield coupled to the first side of the dielectric holder and providing electrical shielding for the signal contacts;

a second ground shield coupled to the second side of the dielectric holder and providing electrical shielding for the signal contacts, the second ground shield having skewer openings; and ground skewers having posts extending from the first ground shield through the dielectric holder openings in the dielectric holder, the posts being electrically connected to the first ground shield, the posts extending into corresponding skewer openings of the second ground shield to electrically connect the first ground shield to the second ground shield.

2. The contact module of claim 1, wherein the first ground shield includes a first panel, each of the ground skewers being physically and electrically connected by the first panel.

3. The contact module of claim 1, wherein the ground skewers are integral with the first ground shield being stamped from the first ground shield and bent perpendicular to the first ground shield to extend through the dielectric holder to directly engage the first ground shield with the second ground shield.

4. The contact module of claim 1, wherein the ground skewers are separate and discrete from the first ground shield and the second ground shield and are received in skewer openings in the first ground shield to electrically connect to the first ground shield.

5. The contact module of claim 1, wherein the posts of the ground skewers are removably coupled to the first ground shield and the second ground shield.

6. The contact module of claim 1, wherein each post includes a bulged section received in the skewer opening to engage the second ground shield by an interference fit.

7. The contact module of claim 1, wherein the second ground shield includes a shield protrusion extending into the skewer opening to engage the corresponding post.

8. The contact module of claim 1, wherein the post includes a compliant portion having a bulged section and a relief slot adjacent the bulged section, the compliant portion being elastically deformed in the skewer opening to mechanically and electrically connect the post to the second ground shield.

9. The contact module of claim 1, wherein the second ground shield includes a relief slot proximate to the skewer opening and a relief beam between the relief slot and the skewer opening, the post engaging the relief beam to elastically deform the relief beam and press the relief beam outward into the relief slot.

10. The contact module of claim 9, wherein the first ground shield includes skewer openings receiving the ground skewers, the first ground shield includes relief slots proximate to the skewer openings in the first ground shield and relief beams between the relief slots and the skewer openings of the first ground shield, the posts engaging the relief beams of the first ground shield to press the relief beams of the first ground shield outward into the relief slots of the first ground shield.

11. The contact module of claim 1, further comprising guard traces held by the dielectric holder along the contact plane between corresponding signal contacts, the guard traces provide electrical shielding between the corresponding signal contacts, the guard traces having guard trace openings, the posts of the ground skewers extending into corresponding guard trace openings to electrically connect the first ground shield and the guard traces.

12. The contact module of claim 11, wherein the guard trace openings are offset from the skewer openings in the second ground shield.

13. The contact module of claim 11, wherein the first ground shield includes skewer openings receiving the ground skewers, each post extending along a post axis, the post including a first mating interface received in the skewer opening of the first ground shield and engaging the first ground shield, a second mating interface received in the skewer opening of the second ground shield and engaging the second ground shield, and a third mating interface received in the guard trace opening and engaging the guard trace.

14. The contact module of claim 13, wherein the first mating interface is laterally offset from the second and third mating interfaces and the second mating interface is laterally offset from the third mating interface.

15. The contact module of claim 13, wherein each post has a first side and a second side, the post including a first protrusion extending from the first side and defining the first mating interface located outward of the first side, the post including a second protrusion extending from the second side and defining the third mating interface located outward of the second side, and the second mating interface being defined at either the first side or the second side.

16. The contact module of claim 11, wherein the guard trace includes a relief slot proximate to the guard trace opening and a relief beam between the relief slot and the guard trace opening, the post engaging the relief beam to press the relief beam outward into the relief slot of the guard trace.

17. The contact module of claim 1, wherein the first ground shield including an interior facing the dielectric holder and an exterior opposite the interior of the first ground shield and the second ground shield includes an interior facing the dielectric holder and an exterior opposite the interior of the second ground shield, the posts of the ground skewers passing through the second ground shield from the interior of the second ground shield to the exterior of the second ground shield.

18. The contact module of claim 1, wherein the posts have distal ends, the posts passing through the second ground shield such that the distal ends of the posts are positioned exterior of the second ground shield.

19. A contact module comprising:

a dielectric holder having first and second sides extending between a mating end and a mounting end;

signal contacts held by the dielectric holder along a contact plane defined between the first and second sides, the signal contacts having mating portions extending from the mating end, mounting portions extending from the mounting end for termination to a circuit board, and transition portions extending through the dielectric holder between the mating and mounting portions;

guard traces held by the dielectric holder along the contact plane between corresponding signal contacts, the guard traces providing electrical shielding between the corresponding signal contacts, the guard traces having guard trace openings;

a ground shield coupled to the first side of the dielectric holder and providing electrical shielding for the signal contacts, the ground shield having skewer openings; and ground skewers separate and discrete from the ground shield, the ground skewers having posts, the posts extending into corresponding skewer openings and into corresponding guard trace openings to electrically connect the ground shield and the guard traces.

20. The contact module of claim 19, wherein each post includes a bulged section received in either the guard trace opening or the skewer opening to engage the guard trace or the ground shield, respectively, by an interference fit.

21. The contact module of claim 19, wherein the ground shield includes a relief slot proximate to the skewer opening and a relief beam between the relief slot and the skewer opening, the post engaging the relief beam to elastically deform the relief beam and press the relief beam outward into the relief slot.

22. A contact module comprising:

a dielectric holder having first and second sides extending between a mating end and a mounting end;

signal contacts held by the dielectric holder along a contact plane defined between the first and second sides, the signal contacts having mating portions extending from the mating end, mounting portions extending from the mounting end for termination to a circuit board, and transition portions extending through the dielectric holder between the mating and mounting portions;

a first ground shield coupled to the first side of the dielectric holder and providing electrical shielding for the signal contacts, the first ground shield having first skewer openings, the first ground shield including an interior facing the dielectric holder and an exterior opposite the interior of the first ground shield;

a second ground shield coupled to the second side of the dielectric holder and providing electrical shielding for the signal contacts, the second ground shield having second skewer openings, the second ground shield including an interior facing the dielectric holder and an exterior opposite the interior of the second ground shield; and ground skewers separate and discrete from the first and second ground shield, the ground skewers having posts extending through the dielectric holder, the posts extending into corresponding first and second skewer openings to electrically connect the first ground shield to the second ground shield, wherein the posts pass through the first ground shield from the exterior of the first ground shield to the interior of the first ground shield, and wherein the posts pass through the second ground shield from the interior of the second ground shield to the exterior of the second ground shield.

* * * * *